United States Patent [19]

Sugiyama et al.

[11] 3,945,930

[45] Mar. 23, 1976

[54] WATER-SOLUBLE METAL WORKING LUBRICANTS

[75] Inventors: Noboru Sugiyama, Shizuoka; Masamichi Suzuki, Shimizu; Katami Watanabe; Keiichi Sugiyama, both of Fuji; Hachiro Tadenuma, Tokyo; Takashi Kato, Yokosuka; Ryoji Kaneda, Zushi; Makoto Yoshino, Yokohama, all of Japan

[73] Assignees: Toho Chemical Industry Co., Ltd.; Nippon Light Metal Research Laboratory, Ltd., both of Tokyo, Japan

[22] Filed: Sept. 30, 1974

[21] Appl. No.: 510,193

[30] Foreign Application Priority Data

Sept. 29, 1973 Japan ..... 48-108913
Nov. 13, 1973 Japan ..... 48-126756

[52] U.S. Cl. ..... 252/32.5; 72/42; 252/49.5; 252/52 A; 252/565

[51] Int. Cl.[2]. C10M 1/44; C10M 3/38; C10M 5/24; C10M 7/24

[58] Field of Search ..... 72/42; 252/32.5, 49.5, 252/52 A, 565

[56] References Cited

UNITED STATES PATENTS

| | | | |
|---|---|---|---|
| 3,788,988 | 1/1974 | Dubourg | 252/49.5 |
| 3,857,865 | 12/1974 | Sturwold et al. | 252/49.5 |
| 3,859,218 | 1/1975 | Jervis et al. | 252/32.5 |

*Primary Examiner*—Delbert E. Gantz
*Assistant Examiner*—I. Vaughn
*Attorney, Agent, or Firm*—Sughrue, Rothwell, Mion, Zinn & Macpeak

[57] ABSTRACT

A lubricating composition for metal working comprising

A. about 10 to 60% by weight of a water-soluble non-ionic surfactant component comprising at least one of i. a polyoxyalkylene glycol ester of a fatty acid represented by the general formula (I)

$$R^1COO(R^2O)_nH \quad (I)$$

or the general formula (II)

$$R^1COO(R^2O)_nOCR^1 \quad (II)$$

ii. a polyoxyalkylene glycol ether of a fatty alcohol represented by the general formula (III)

$$R^3O(R^2O)_nH \quad (III)$$

iii. a polyoxyalkylene glycol ether of a fatty alcohol esterified with a fatty acid represented by the general formula (IV)

$$R^3O(R^2O)_nOCR^1 \quad (IV)$$

iv. a polyoxyalkylene glycol condensate of a glyceride esterified with a fatty acid represented by the general formula (V)

$$\begin{array}{l} CH_2OCOR^{1'}O(R^2O)_pOCR^1 \\ | \\ CH-OCOR^{1'}O(R^2O)_qR^4 \\ | \\ CH_2OCOR^{1'}O(R^2O)_rR^4; \end{array} \quad (V)$$

B. about 10 to 40% by weight of an oil-soluble nonionic surfactant component comprising at least one of i. a polyoxyalkylene glycol ester of a fatty acid represented by the general formula (VI)

$$R^1COO(R^5O)_mH \quad (VI)$$

or the general formula (VII)

$$R^1COO(R^5O)_mOCR^1 \quad (VII)$$

ii. a polyoxyalkylene glycol ether of a fatty alcohol represented by the general formula (VIII)

$$R^3O(R^5O)_mH \quad (VIII)$$

iii. a polyoxyalkylene glycol ether of a fatty alcohol esterified with a fatty acid represented by the general formula (IX)

$$R^3O(R^5O)_mOCR^1 \quad (IX)$$

and iv. a polyoxyalkylene glycol condensate of a glyceride esterified with a fatty acid represented by the general formula (X)

$$\begin{array}{l} CH_2OCOR^{1'}O(R^5O)_sOCR^1 \\ | \\ CH-OCOR^{1'}O(R^5O)_tR^4 \\ | \\ CH_2OCOR^{1'}O(R^5O)_uR^4 \text{ ; and} \end{array} \quad (X)$$

C. about 10 to 50% by weight of an anionic or nonionic surfactant component comprising at least one of i. a phosphate ester and/or salt of a phosphate ester with the adduct of a polyoxyalkylene glycol, with an alcohol or an alkylphenol represented by the general formula (XI)

$$R^6O(R^2O)_a-\overset{\overset{O}{\|}}{\underset{\underset{OM}{|}}{P}}-OM \quad (XI)$$

the general formula (XII)

$$R^6O(R^2O)_b-\overset{\overset{O}{\|}}{\underset{\underset{OM}{|}}{P}}-(R^2O)_bOR^6 \quad (XII)$$

or the general formula (XIII)

$$R^6O(R^2O)_d-\overset{\overset{O}{\|}}{\underset{\underset{(R^2O)_fOR^6}{|}}{P}}-(R^2O)_eOR^6 \quad (XIII)$$

ii. an alkali metal salt, alkylamine salt and/or alkanolamine salt of a fatty acid represented by the general formula (XIV)

$$R^1COOM \quad (XIV).$$

WATER-SOLUBLE METAL WORKING LUBRICANTS

BACKGROUND OF THE INVENTION

1. Field of the Invention

The present invention relates to lubricant compositions useful in the working of metals. More particularly, the present invention relates to lubricating fluids useful in plastic deformation processes such as rolling, forging and drawing to offer sufficient lubricity for the materials being worked and the tools being employed and also to provide the worked-products with a beautiful surface finish.

2. Description of the Prior Art

It is well-known that non-soluble oils such as straight mineral, i.e., without an emulsifier, or fatty oils are not completely satisfactory for the working of metals from the standpoint of cooling ability. Thus, emulsion-type lubricants based on mineral or fatty oils have been used conventionally for plastic deformation processes in which a high cooling ability is required in, for example, the hot rolling of aluminium, the manufacturing of aluminium cans by a drawing and ironing process, the cold rolling of steel and so forth. These conventional emulsions contain as an emulsifier, anionic surfactants such as petroleum sulfonates, resin soaps, fatty acid soaps, etc., or nonionic surfactants such as sorbitan alkyl esters, polyoxyethylene sorbitan alkyl esters, etc., having a good cooling ability. However, emulsion-type lubricants have several inherent problems, such as, for example, emulsion stability: the oil droplet sizes of these emulsions tend to increase after some weeks of plant use, particularly in the case of the hot rolling of aluminium, resulting in poor performance, namely the prevalence of uneven lubrication, the removal of oil droplets by filters necessary to remove oxide particles and so forth. Sometimes, in order to obtain a better surface finish on rolled products, emulsion formulations are intentionally designed so that the emulsions are rather unstable. However, this tends to lead to an incidence of refusal at bite. This means that in the case of emulsion-type rolling lubricants, it is somewhat difficult to make a compromise between the surface finish of rolled products and the rollability. Conventional water-soluble lubricating compositions for metal working are disclosed in, for example, U.S. Pat. Nos. 3,492,232, 3,496,104, 3,634,245, etc. However, these prior art water-soluble lubricating compositions are still insufficient, particularly with respect to surface finish characteristics, when they are employed.

SUMMARY OF THE INVENTION

The present invention now provides water-soluble lubricating formulations overcoming the above-described drawbacks of straight oils or emulsion-type lubricants. The lubricants of the present invention comprise water-soluble nonionic surfactants as a solubilizer, oil-soluble nonionic surfactants as an oiliness agent and phosphate esters (and/or their salts) and/or fatty acid soaps as a "plating-out"* agent. The term "plating-out" as used herein designates the phenomenon where films of the oil-soluble surfactants deposited on the material and the tools are uniformly spread over their surfaces.

* The term "plating-out" is usually used to describe one of the characteristics of the emulsions for the cold rolling of steel. The emulsion applied to the rolls and the strips to be rolled is broken and the deposited oil film on the metals spreads over their surfaces. This breaking and spreading phenomenon is referred to as "plating-out".

This invention provides a lubricating composition for metal working comprising

A. about 10 to 60% by weight of a water-soluble nonionic surfactant component comprising at least one of i. a polyoxyalkylene glycol ester of a fatty acid represented by the general formula (I)

$$R^1COO(R^2O)_nH \quad (I)$$

or the general formula (II)

$$R^1COO(R^2O)_nOCR^1 \quad (II)$$

ii. a polyoxyalkylene glycol ether of a fatty alcohol represented by the general formula (III)

$$R^3O(R^2O)_nH \quad (III)$$

iii. a polyoxyalkylene glycol ether of a fatty alcohol esterified with a fatty acid represented by the general formula (IV)

$$R^3O(R^2O)_nOCR^1 \quad (IV)$$

and iv. a polyoxyalkylene glycol condensate of a glyceride esterified with a fatty acid represented by the general formula (V)

$$\begin{array}{l} CH_2OCOR^{1\prime}O(R^2O)_pOCR^1 \\ | \\ CH-OCOR^{1\prime}O(R^2O)_qR^4 \\ | \\ CH_2OCOR^{1\prime}O(R^2O)_rR^4 \end{array} \quad (V)$$

wherein $R^1CO$ represents a saturated or unsaturated fatty acid acyl group having about 12 to 22 carbon atoms;

$R^{1\prime}CO$ represents a saturated or unsaturated fatty acid acyl group having about 12 to 22 carbon atoms and containing a hydroxy group;

$R^2$ represents an ethylene group;

$R^3$ represents an alkyl or alkenyl group having about 12 to 22 carbon atoms;

$R^4$ represents a hydrogen atom or a $R^1CO$ group;

$n$ is an integer of about 10 to 20; and $p$, $q$, $r$, each is an integer with the sum of p, q and r ranging from about 25 to 40 when one or both of $R^4$ is a hydrogen atom and from about 40 to 60 when $R^4$ is a $R^1CO$ group;

B. about 10 to 40% by weight of an oil-soluble nonionic surfactant component comprising at least one of i. a polyoxyalkylene glycol ester of a fatty acid represented by the general formula (VI)

$$R^1COO(R^5O)_mH \quad (VI)$$

or the general formula (VII)

$$R^1COO(R^5O)_mOCR^1 \quad (VII)$$

ii. a polyoxyalkylene glycol ether of a fatty alcohol represented by the general formula (VIII)

$$R^3O(R^5O)_mH \quad (VIII)$$

iii. a polyoxyalkylene glycol ether of a fatty alcohol esterified with a fatty acid represented by the general formula (IX)

$$R^3O(R^5O)_mOCR^1 \quad (IX)$$

and iv. a polyoxyalkylene glycol condensate of a glyceride esterified with a fatty acid represented by the general formula (X)

$$\begin{array}{l} CH_2OCOR^{1'}O(R^5O)_sOCR^1 \\ CH-OCOR^{1'}O(R^5O)_tR^4 \\ CH_2OCOR^{1'}O(R^5O)_uR^4 \end{array} \quad (X)$$

wherein $R^{1'}$ CO, $R^2$, $R^3$ and $R^4$ are as defined above;

$R^5$ is an alkylene group having 2 to 4 carbon atoms

*m* is an integer of about 1 to 5; and

*s*, *t* and *u* each is an integer with the sum of *s*, *t* and *u* ranging from about 3 to 20;

and

C. about 10 to 50% by weight of an anionic or nonionic surfactant component comprising at least one of i. a phosphate ester and/or salt of a phosphate ester with the adduct of a polyoxyalkylene glycol with an alcohol or an alkylphenol represented by the general formula (XI)

$$R^6O(R^2O)_a-\overset{\overset{O}{\|}}{\underset{\underset{OM}{|}}{P}}-OM \quad (XI)$$

the general formula (XII)

$$R^6O(R^2O)_b-\overset{\overset{O}{\|}}{\underset{\underset{M}{|}}{P}}-(R^2O)_bOR^6 \quad (XII)$$

or the general formula (XIII)

$$R^6O(R^2O)_d-\overset{\overset{O}{\|}}{\underset{\underset{(R^2O)_fOR^6}{|}}{P}}-(R^2O)_bOR^6 \quad (XIII)$$

wherein $R^2$ is as defined above; $R^6$ is an alkyl group, an alkenyl group or an alkaryl group having about 12 to 18 carbon atoms;

M is an alkali metal atom, an alkylamine group or an alkanolamine group;

*a* is an integer ranging from about 2 to 15;

*b* and *c* each is an integer with the sum of *b* and *c* divided by 2 ranging from about 2 to 15; and *c*, *d* and *e* each is an integer with the sum of *c*, *d* and *e* divided by 3 ranging from about 3 to 10;

and ii. an alkali metal salt, alkylamine salt and/or alkanolamine salt of a fatty acid represented by the general formula (XIV)

$$R^1COOM \quad (XIV)$$

wherein $R^1CO$ and M are as above defined.

DETAILED DESCRIPTION OF THE INVENTION

The oil-soluble nonionic surfactants employed in the water-soluble lubricant of the present invention function as a load-bearing additive. Since oil-soluble surfactants cannot be dissolved in water by themselves, water-soluble nonionic surfactants are indispensable as a solubilizer in order to obtain the water-soluble lubricant of the present invention. Since the phosphate esters (and/or their salts) and/or fatty acid soaps employed in the water-soluble lubricants of the present invention are highly surface-active and have a fairly strong affinity for oil-soluble surfactants, they function as a good plating-out agent.

The presence of the plating-out agent actually results in a more uniform lubrication during use and ultimately a better surface finish of the worked products.

The lubricants of the present invention are water-soluble and are used by dilution with water, forming transparent or semi-transparent solutions. Since the solutions are single-phase and highly surface-active, they show improved stability, improved cooling ability, excellent uniform lubrication and increased bite of the rolls. For example, solution-type lubricants used for the hot rolling of aluminium are free from the instability of emulsion-type lubricants and show consistent performance for a plant life of several months or longer and the surface finish of the rolled products is excellent.

The nonionic surfactants employed in the water-soluble lubricants of the present invention include polyoxyalkylene glycol esters of fatty acids, polyoxyalkylene glycol ethers of fatty alcohols, polyoxyalkylene glycol ethers of fatty alcohols esterified with fatty acids and polyoxyalkylene glycol condensates of glycerides esterified with fatty acids.

The alkylene oxides in the compounds employed in the present invention contain 2 to 4 carbon atoms in the oil-soluble surfactants and contain 2 carbon atoms (ethylene oxide) in the water-soluble surfactants. The nonionic surfactants employed in the present invention are water-soluble or oil-soluble, depending upon the number of alkylene oxide molecules and also the number of carbon atoms of the alkylene group.

The nonionic surfactants employed in the present invention are explained in detail as follows:

The polyoxyalkylene glycol esters of fatty acids employed are mono or di-esters represented by the formulas (I), (II), (VI) or (VII)

$$R^1COO(R^2O)_nH \quad (I)$$

$$R^1COO(R^2O)_nOCR^1 \quad (II)$$

$$R^1COO(R^5O)_mH \quad (VI)$$

$$R^1COO(R^5O)_mH \quad (VII)$$

wherein $R^1CO$, $R^2$, $R^5$, n and m are as above defined.

The saturated or unsaturated fatty acid acyl groups for $R^1CO$ are the residues of saturated and unsaturated fatty acids and mixtures thereof. Suitable saturated and unsaturated fatty acids include lauric, myristic, palmitic, stearic, arachidic, behenic, linderic, myristooleic, palmitooleic, oleic, gadoleic, erucic, linolenic, arachidonic, ricinoleic acids, etc. Mixtures are, i.e., the mixtures of fatty acids found in rape seed oil, soybean oil, rice bran oil, palm oil, cotton seed oil, peanut oil, sesame oil, corn oil, lard oil, tallow oil, train oil, etc. Suitable alkylene groups for $R^5$ are ethylene, propylene and butylene.

Of the polyoxyethylene or polyoxyalkylene glycol esters of fatty acids of the formula (I), (II), (VI) or (VII), those having about 10 to 20 molecules of ethylene oxide per fatty acid residue, i.e., an n of about 10 to 20, are preferably employed as water-soluble esters, and those having about 1 to 5 molecules of an alkylene oxide, e.g., ethylene oxide, per fatty acid residue, i.e., an m of about 1 to 5, are preferably employed as oil-soluble esters.

The polyoxyalkylene glycol ethers of fatty alcohols employed in the present invention are those represented by the formulas (III) or (VIII).

$$R^3O(R^2O)_nH \qquad \text{(III)}$$

$$R^3O(R^5O)_mH \qquad \text{(VIII)}$$

wherein $R^2$, $R^3$, $R^5$, n and m are as above defined.

The alkyl or alkenyl groups for $R^3$ are residues of saturated and unsaturated fatty alcohols and mixtures thereof. Suitable saturated and unsaturated alcohols include lauryl, myristyl, palmytyl, stearyl, arachidyl, behenyl, lindeıyl, myristooleyl, palmitooleyl, oleyl, gadoleyl, erucyl, linolenyl, arachidonyl, ricinolyl alcohols, etc.

The relationship between the water solubility and oil solubility and the number of the ethylene oxide molecules for the ethers of the formula (III) and the alkylene oxide, e.g., ethylene oxide, for the ethers of the formula (VIII) is the same as in the case of the esters, of the formulas (I) and (VI) respectively, i.e., an *n* of about 10 to 20 and an *m* of about 1 to 5.

The polyoxyalkylene glycol ethers of fatty alchols esterified with fatty acids are those represented by the formulas (IV) and (IX).

$$R^3O(R^2O)_nOCR^1 \qquad \text{(IV)}$$

$$R^3O(R^5O)_mOCR^1 \qquad \text{(IX)}$$

wherein $R^1CO$, $R^2$, $R^3$, $R^5$, n and m are as above defined.

Suitable examples of saturated and unsaturated fatty acids and fatty alcohols for the compounds of formula (IV) and (IX) are as hereinbefore described for, e.g., the compounds of the formula (I) and (VI).

The relationship between the water solubility and the number of the ethylene oxide molecules for the ether-ester type compounds of the formula (III) and the alkylene oxide molecules for the ether-ester type compounds of the formula (IX) is the same as in the cases of the esters and the ethers, of the formulas (I) and (VI), respectively, i.e., an n of about 10 to 20 and an m of about 1 to 5.

The polyoxyalkylene glycol condensates of glycerides esterified with fatty acids are those represented by the formula (V), and (X).

$$\begin{array}{l} CH_2OCOR^1{}'O(R^2O)_pOCR^1 \\ | \\ CH-OCOR^1{}'O(R^2O)_qR^4 \\ | \\ CH_2OCOR^1{}'O(R^2O)_rR^4 \end{array} \qquad \text{(V)}$$

$$\begin{array}{l} CH_2OCOR^1{}'O(R^5O)_sOCR^1 \\ | \\ CH-OCOR^1{}'O(R^5O)_tR^4 \\ | \\ CH_2OCOR^1{}'O(R^5O)_uR^4 \end{array} \qquad \text{(X)}$$

wherein $R^1$ CO, $R^2$, $R^4$, $R^5$, *p*, *q*, *r*, *s*, *t* and *u* are as above defined.

Suitable examples of saturated and unsaturated fatty acid acyl groups for $R^1$ CO are the residues of 12-hydroxy stearic acid and ricinoleic acid, with ricinoleic acid being preferred. A suitable glyceride is a triglyceride of castor oil containing ricinoleic acid.

Of the condensates, mono- or di-ester compounds of the formula (V) having about 25 to 40 molecules of ethylene oxide (i.e., $p + q + r =$ about 25 to 40) and tri-ester compounds of the formula (V) having about 40 to 60 molecules of ethylene oxide (i.e., $p + q + r =$ about 40 to 60) are preferably employed as water-soluble surfactants, while condensates of the formula (X) having about 3 to 30 molecules of an alkylene oxide, e.g., ethylene oxide (i.e., $s + t + u =$ about 3 to 20) are preferably employed as oil-soluble surfactants.

The phosphate esters employed in the present invention are anionic surfactants represented by the formula (XI), (XII) and (XIII)

$$R^6O(R^2O)_a-\overset{\overset{\displaystyle O}{\|}}{\underset{\underset{\displaystyle OM}{|}}{P}}-OM \qquad \text{(XI)}$$

$$R^6O(R^2O)_b-\overset{\overset{\displaystyle O}{\|}}{\underset{\underset{\displaystyle M}{|}}{P}}-(R^2O)_cOR^6 \qquad \text{(XII)}$$

$$R^6O(R^2O)_d-\overset{\overset{\displaystyle O}{\|}}{\underset{\underset{\displaystyle (R^2O)_fOR^6}{|}}{P}}-(R^2O)_eOR^6 \qquad \text{(XIII)}$$

wherein $R^2$, $R^6$, *a*, *b*, *c*, *d*, *e*, and *f* are as above defined.

Suitable alkyl and alkenyl groups for $R^6$ are the same as $R^3$ as described for formula (III), e.g., lauryl, myristyl, palmityl, stearyl and oleyl groups. Suitable alkylaryl groups for $R^6$ are nonylphenyl, octylphenyl, decylphenyl, and so forth.

Suitable examples for M of alkali metals are sodium and potassium, of alkylamines are mono-, di- and triamines having 1 to 4 carbon atoms in the alkyl moiety thereof such as methyl, ethyl, propyl and butyl, and of alkanol amines are mono-, di-, and trialkanolamines such as mono-, di- and triethanol amine.

The average number of ethylene oxide molecules in (VI) or (XII) preferably ranges from about 2 to 15 (i.e., in formula (XI) $a =$ about 2 to 15, and in formula (XII) $(b + c)/2 =$ about 2 to 15), and in formula (XIII) ranges from about 3 to 10 (i.e., $(d + e + f)/3 =$ about 3 to 10). In the last case, if the total number exceeds 10, blending is difficult with the other ingredients.

The present invention provides a lubricating composition for metal working comprising (A), (B) and (C) class of compounds as described above.

The compositions can be considerably varied in proportion: about 10 to 60% by weight of water-soluble nonionic surfactants (A), about 10 to 40% by weight of water-insoluble (or oil-soluble) nonionic surfactants (B) and about 10 to 50% by weight of the phosphate esters or fatty acid salts (C).

When the water-soluble working lubricants of the present invention are diluted with water, e.g., to form a solution of a concentration of about 3 to 20% by weight of the lubricating composition, the water-soluble nonionic surfactants dissolve in water, forming micelles. The micelles can solubilize oil-soluble nonionic surfactants which do not dissolve in water by themselves.

Since the water-soluble surfactants (A) and the oil-soluble surfactants (B) have similar hydrophillic structures to each other and also have similar oleophillic structures to each other, they have a strong affinity for each other. This affinity is essential for solubilizing the oil-soluble surfactants (B) by the water-soluble surfactants (A). Furthermore, the phosphate esters and/or the salts of phosphate esters and/or the salts of fatty acids (C) involved in the present invention function as a plating-out agent and cause the nonionic surfactants (A) and (B) to spread over the material and the tool surfaces to leave an appropriate amount of load-bearing oil film on the surfaces. By the combined action of the above-described factors, the metal working lubricants of the present invention provide improved stability, improved cooling ability, excellent uniform lubrication and excellent surface finish.

The metal working lubricants of the present invention comprise water-soluble nonionic surfactants (A), oil-soluble nonionic surfactants (B) and phosphate esters and/or salts of fatty acids (C) and are used by dilution with water. When diluted, the lubricants of the present invention can further be combined with water-soluble solvents, such as glycols, glycol ethers and so forth, e.g., in an amount of up to about 20% by weight based on the total weight of the composition. These solvents provide the lubricants with better solubility. Preferred solvents are ethylene glycol, polyethylene glycols having a molecular weight of less than about 600, alkylene glycols having less than about 6 carbon atoms, glycol ethers of lower alcohols having less than about 4 carbon atoms and lower alkanolamines. Additionally, mineral or fatty acids can be combined with the lubricants of the present invention to adjust lubricity, to the extent that the water-solubility is not lost, e.g., in an amount of up to about 20% by weight based on the total weight of the composition.

The following examples are given to illustrate the invention in greater detail. Unless otherwise indicated, in the Examples, all parts, percents, ratios and the like are by weight.

In the Examples given hereinafter the performance of the lubricant compositions of this invention and comparative lubricant compositions were tested in the following manner.

A. Hot Rolling Test

Hot rolling tests were conducted under the following conditions:

Rolling Mill: 2 high mill, 350 $^{mmo}$ × 575 $^{mml}$
Rolling Stab: 99.7% Al, 56 $^{mmt}$ × 135 $^{mmw}$ × 355 $^{mml}$
Slab Temperature: 580° – 550°C - 310° – 260°C (initial → final)
Pass Schedule: 56 → 46 → 37 → 26 → 17 → 10 → 6 $^{mmt}$ (6 passes)
Solution Temperature: 60°C
Rolling Speed: 20 – 30 m/min
Roll Surface Roughness: 1.0 – 1.5 $\mu$ Hmax Rolling loads, strip surface roughness values and strip surface reflectance values were measured. The incidence of refusal at bite and strip surface appearance were also observed.

B. Cold Rolling Test

Cold rolling tests were conducted under the following conditions:

Rolling Mill: 2 high mill, 350 $^{mmo}$ × 575 $^{mml}$
Rolling Sheet: 2S-O, 1.0 $^{mmt}$ × 150 $^{mmw}$ × 930 $^{mml}$
Reduction: 30%
Rolling Speed: 10 m/min
Roll Surface Roughness: 1.0 – 1.5 $\mu$ Hmax The coefficients of friction were calculated by using Hill's equation.

C. Deep-Drawing Test

Deep-drawing tests were conducted under the following conditions:

Press: Swift cup-forming press
Punch Diameter: 51.0 mm
Die-Hole Diameter: 54 mm
Punch-Nose Profile Radius: 3.5 mm
Die-Entry Profile Radius: 10 mm
Blank Holder Pressure: 6 kg/cm$^2$
Blank: 100 – 120 $^{mmo}$ × 1.0 $^{mmt}$, 2S-O
Drawing Speed: 300 mm/min The L.D.R. (limiting drawing ratio) was measured.

Table 1

| Component | Example 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| Water-Soluble Nonionic Surfactant (A) | | | | | | | | | | | | | | | | | | | | |
| (a) | 45 | 45 | 45 | 45 | 45 | 45 | — | — | — | — | 10 | 45 | 45 | 45 | 10 | — | — | 50 | — | — |
| (b) | — | — | — | — | — | — | 45 | — | — | — | — | — | — | — | — | 45 | — | — | 35 | — |
| (c) | — | — | — | — | — | — | — | 45 | — | — | — | — | — | — | — | — | 20 | — | — | 30 |
| (d) | — | — | — | — | — | — | — | — | 45 | — | — | — | — | — | — | — | — | — | — | — |
| (e) | — | — | — | — | — | — | — | — | — | 45 | — | — | — | — | — | — | 20 | — | — | — |
| Oil-Soluble Nonionic Surfactant (B) | | | | | | | | | | | | | | | | | | | | |
| (f) | — | — | — | — | — | — | — | — | — | — | — | — | — | — | — | 25 | — | 10 | 21 | — |
| (g) | 35 | 35 | 35 | — | — | — | 35 | 35 | 35 | 35 | 40 | 35 | 35 | 35 | 40 | — | — | 15 | — | — |
| (h) | — | — | — | 35 | — | — | — | — | — | — | — | — | — | — | — | — | 30 | — | — | 40 |
| (i) | — | — | — | — | 35 | — | — | — | — | — | — | — | — | — | — | — | — | — | — | — |
| (j) | — | — | — | — | — | 35 | — | — | — | — | — | — | — | — | — | — | — | — | — | — |

| Composition | Example 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| Plating-Out Agent (C) Phosphate Ester or Salt | | | | | | | | | | | | | | | | | | | | |
| (k) | 20 | — | — | 20 | 20 | 20 | 20 | 20 | 20 | 20 | 50 | — | — | — | 20 | — | 15 | — | — | — |
| (l) | — | 20 | — | — | — | — | — | — | — | — | — | — | — | — | — | 20 | — | — | — | — |
| (m) | — | — | 20 | — | — | — | — | — | — | — | — | — | — | — | — | — | — | 15 | — | — |
| Fatty Acid Soap | | | | | | | | | | | | | | | | | | | | |
| (n) | — | — | — | — | — | — | — | — | — | — | — | — | 20 | — | — | — | — | — | — | — |
| (o) | — | — | — | — | — | — | — | — | — | — | — | — | — | 20 | — | — | — | — | — | — |
| (p) | — | — | — | — | — | — | — | — | — | — | — | 20 | — | — | 30 | — | — | — | 15 | 10 |
| Solvent & Others | | | | | | | | | | | | | | | | | | | | |
| Solvent | | | | | | | | | | | | | | | | | | | | |
| (q) | — | — | — | — | — | — | — | — | — | — | — | — | — | — | — | — | — | 10 | — | 10 |
| (r) | — | — | — | — | — | — | — | — | — | — | — | — | — | — | — | 10 | — | — | — | — |
| (s) | — | — | — | — | — | — | — | — | — | — | — | — | — | — | — | — | 10 | — | 12 | — |
| Others | | | | | | | | | | | | | | | | | | | | |
| (t) | — | — | — | — | — | — | — | — | — | — | — | — | — | — | — | — | 5 | — | 10 | — |
| (u) | — | — | — | — | — | — | — | — | — | — | — | — | — | — | — | — | — | — | — | 10 |
| (v) | — | — | — | — | — | — | — | — | — | — | — | — | — | — | — | — | — | — | | — |

a. Polyoxyethylene glycol di-ester of the acids of rape seed oil $R^1COO(C_2H_4O)_nOCR^1$ $R^1CO$ is the acyl group of the fatty acids of rape seed oil such as erucic ($C_{22}H_{42}O_2$), linolenic ($C_{18}H_{30}O_2$) and $n$ is 15 b. Polyoxyethylene glycol mono-oleyl ester etc.

$R^1COO(C_2H_4O)_nH$ $R^1CO$ is $C_{17}H_{33}CO$ and $n$ is 10 c. Polyoxyethylene glycol lauryl ether $R^3O(C_2H_4O)_nH$ $R^3$ is $C_{12}H_{25}$- and $n$ is 20 d. Polyoxyethylene glycol lauryl ether esterified with the acids of rape seed oil $R^3O(C_2H_4O)_nOCR^1$ $R^3$ is $C_{12}H_{25}$, $R^1CO$ is the acyl group of the acids of rape seed oil as described for (a) above, and $n$ is 25 e. Polyoxyethylene glycol condensate of castor oil esterified with oleic acid $$\begin{array}{l} CH_2OCO(CH_2)_7CH{=}CHCH_2CH(CH_2)_5CH_3 \\ \qquad\qquad\qquad\qquad\qquad\qquad | \\ \qquad\qquad\qquad\qquad\qquad O(C_2H_4O)_pOC(CH_2)_7CH{=}CH(CH_2)_7CH_3 \\ | \\ CHOCO(CH_2)_7CH{=}CHCH_2CH(CH_2)_5CH_3 \\ \qquad\qquad\qquad\qquad\qquad\qquad | \\ \qquad\qquad\qquad\qquad\qquad O(C_2H_4O)_qH(\text{or } OC(CH_2)_7CH{=}CH(CH_2)_7CH_3) \\ | \\ CH_2OCO(CH_2)_7CH{=}CHCH_2CH(CH_2)_5CH_3 \\ \qquad\qquad\qquad\qquad\qquad\qquad | \\ \qquad\qquad\qquad\qquad\qquad O(C_2H_4O)_rH(\text{or } OC(CH_2)_7CH{=}CH(CH_2)_7CH_3) \end{array}$$

$p + q + r = 60$ f. Polyoxyethylene glycol mono-lauryl ester $R^1COO(C_2H_4O)_mH$ $R^1CO$ is $C_{11}H_{33}CO$ and $m$ is 2 g. Polyoxyethylene glycol di-oleyl ester $R^1COO(C_2H_4O)_mOCR^1$ $R^1CO$ is $C_{17}H_{33}CO$ and $m$ is 2 h. Polyoxyethylene glycol lauryl ether $R^3O(C_2H_4O)_mH$ $R^3$ is $C_{12}H_{25}$- and $m$ is 2 i. Polyoxyethylene glycol oleyl ether esterified with the acids of soybean oil $R^3O(C_2H_4O)_mOCR^1$ $R^3$ is $C_{18}H_{33}$-

$R^1CO$ is the acyl group of the acids of soybean oil such as linolenic ($C_{18}H_{30}O_2$) and $m$ is 2 j. Polyoxyethylene glycol condensate of castor oil esterified with the acids of rape seed oil $$\begin{array}{l} CH_2OCOR^{1\prime} \\ | \\ CHOCOR^{1\prime} \\ | \\ CH_2OCOR \end{array}$$

$R^1CO$ is the acyl group of ricinoleic acid ($CH_3(CH_2)_5CH(OH)CH_2.\ CH{=}CH.(CH_2)_7COOH$), $R^1CO$ is the acyl group of the acids of rape seed oil, as described in (a) above, and $s + t + u$ is 10 k. Mixtures of the triethanolamine salts of mono- and di-phosphate esters of the adduct of polyoxyethylene glycol with oleyl alcohol

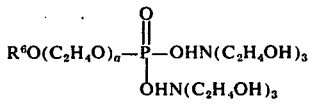

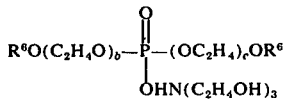

$R^6$ is $C_{18}H_{33}$—, and
$a$ or $(b + c/2 = 4$ l. Mixtures of the triethanolamine salts of mono- and di-phosphate esters of the adduct of polyoxyethylene glycol with nonylphenol

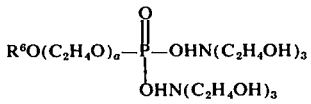

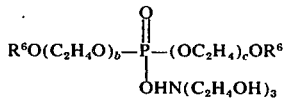

$R^6$ is $CH_3(CH_2)_8C_6H_4$-, and
$a$ or $(b + c)/2 = 8$ m. Tri-phosphate ester of the adduct of polyoxyethylene glycol with oleyl alcohol

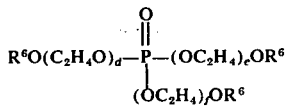

$R^6$ is $C_{18}H_{33}$, and
$(d + e + f)/3 = 8$ n. Potassium salt of acids of rape seed oil $R^1COOK$ $R^1CO$ is the acyl group of the acids of rape seed oil, as described in (a) above o. Dicyclohexylamine salt of oleic acid $$C_{17}H_{33}COOH.NH.[CH_2(CH_2)_4CH]_2$$

p. Tri-ethanolamine of oleic acid $$C_{17}H_{33}COOH.N(C_2H_4OH)_3$$

q. Ethylene glycol $$HOCH_2.CH_2OH$$

r. Hexylene glycol $$HO(CH_2)_6OH$$

s. Butyl carbitol $$CH_3(CH_2)_3O(C_2H_4O)_2H$$

t. Lard oil
u. Rape seed oil
v. Mineral oil

EXAMPLE 1

A water-soluble lubricating composition was made up containing the components shown as Example 1 in Table 1. Five parts of this lubricant were diluted with 95 parts of water, forming a transparent solution. The solution was tested on a rolling mill as an aluminium hot and cold rolling fluid. The results obtained are shown in Table 2, together with, for comparison, those of a commercially available hot rolling emulsion, commercially available cold rolling lubricants and solutions of one or two of the three components employed in the present invention.

Table 2

| Lubricant | Total Rolling Load of 6 Passes (t) | Roughness of Rolled Sheet (Hmax) (μ) | Hot Rolling Reflectance of Rolled Sheet, (%) As Hot-Rolled | As Anodized | Bite of the Rolls | Surface Appearance of Anodized Sheet | Cold Rolling Coefficient of Friction |
|---|---|---|---|---|---|---|---|
| 5% Solution of Example 1 | 167 | 1.8 | 21.0 | 4.3 | Good | Excellent | 0.15 |
| 5% Solution of (a) | 185 | 3.0 | 8.5 | 1.2 | " | Heavy pick-up | —* |
| 5% Solution of (l) | 180 | 2.4 | 9.7 | 1.4 | " | " | — |
| 5% Solution of (b)+(l) ( (b):(l)=1:1) | 186 | 1.9 | 13.1 | 3.1 | " | Poor | 0.25 |
| 5% Solution of (a)+(f) ( (a):(f)=1:1) | 169 | 1.8 | 13.5 | 4.1 | " | Patchy Defects | — |
| 5% Emulsion | 186 | 2.4 | 12.6 | 2.5 | Frequent refusal | Pick-up | — |
| Mineral Seal Oil | — | — | — | — | — | — | 0.23 |
| Mineral Seal Oil + 4% Lauryl Alcohol | — | — | — | — | — | — | 0.13 |

*Not carried out

EXAMPLES 2 to 20

Water-soluble lubricating compositions were made up containing the components as shown for each of the examples in Table 1. Five parts of each of the lubricants were diluted with 95 parts of water, forming a transparent solution in each case. The solutions were tested on a rolling mill as either an aluminum hot or cold rolling fluid. The results obtained are shown in Table 3.

Table 3

| Lubricant[1] Example | Total Rolling Load of 6 Passes (t) | Roughness of Rolled Sheet (Hmax) (μ) | Hot Rolling Reflectance of Rolled Sheet (%) As Hot-Rolled | As Anodized | Bite of the Rolls | Surface Appearance of Anodized Sheet | Cold Rolling Coefficient of Friction |
|---|---|---|---|---|---|---|---|
| 2 | 170 | 2.1 | 20.9 | 4.0 | Good | Excellent | — |
| 3 | — | — | — | — | — | — | 0.15 |
| 4 | 180 | 2.0 | 18.7 | 4.8 | Good | Excellent | — |
| 5 | 178 | 1.8 | 18.3 | 4.0 | Good | Excellent | — |
| 6 | 173 | 1.9 | 21.8 | 4.7 | Good | Excellent | — |
| 7 | 180 | 1.7 | 19.9 | 5.0 | Good | Excellent | — |
| 8 | 180 | 1.9 | 18.2 | 3.8 | Good | Excellent | — |
| 9 | 171 | 1.7 | 21.2 | 4.0 | Good | Excellent | — |
| 10 | 177 | 1.3 | 20.4 | 4.9 | Good | Excellent | 0.12 |
| 11 | 173 | 1.9 | 21.8 | 5.8 | Good | Excellent | — |
| 12 | 170 | 1.6 | 20.6 | 4.2 | Good | Excellent | — |
| 13 | 174 | 1.8 | 19.7 | 3.9 | Good | Excellent | — |
| 14 | 176 | 2.0 | 19.3 | 4.1 | Good | Excellent | — |
| 15 | 180 | 2.1 | 18.0 | 3.7 | Good | Excellent | — |
| 16 | 175 | 1.8 | 20.7 | 4.3 | Good | Excellent | — |
| 17 | — | — | — | — | — | — | 0.12 |
| 18 | 160 | 2.0 | 18.1 | 4.2 | Good | Excellent | — |
| 19 | 160 | 1.8 | 28.7 | 5.8 | Good | Excellent | 0.11 |
| 20 | 164 | 1.4 | 18.2 | 3.8 | Good | Excellent | 0.11 |

[1]5% by weight solution of each lubricant composition in water

In addition a deep-drawing test of the lubricating composition of Example 11 (5% by weight solution) as shown in Table 1, of machine oil and of rape seed oil was conducted and the results obtained are shown in Table 4 below.

Table 4

| Lubricant | L.D.R. |
|---|---|
| 5% Solution of Example 11 | 2.12 |
| Machine Oil | 2.07 |
| Rape Seed Oil | 2.10 |

Similarly a deep-drawing test of the lubricating composition of Example 19 (5% by weight solution), as shown in Table 1, was conducted and the LDR obtained was 2.14.

As can be seen from the above Tables 2,3 and 4 showing the rolling and deep-drawing test results of the water-soluble lubricants of the present invention, together with those of a conventional hot rolling emulsion, conventional cold rolling oils and solutions containing one or two of the three components employed in the present invention, the water-soluble lubricants of the present invention are all superior to any other lubricants in hot rolling performance, as demonstrated by the rolling load, the surface roughness of the rolled sheets, the reflectance of the rolled sheet, bite of the rolls and the surface appearance of the anodized sheet. In addition, the water-soluble lubricants of the present invention are all equal to or even superior to any conventional cold rolling or deep-drawing oils in lubricating properties, as demonstrated by the coefficient of friction or the Limiting Drawing Ratio. Also it is essential, in order to obtain excellent metal working performances, that all three components (A), (B) and (C) must be employed in the water-soluble lubricants of the present invention.

While the invention has been described in detail and with reference to specific embodiments thereof, it will be apparent to one skilled in the art that various changes and modifications can be made therein without departing from the spirit and scope thereof.

What is claimed is:

1. A lubricating composition for metal working comprising

A. about 10 to 60% by weight of a water-soluble non-ionic surfactant component comprising at least one of i. a polyoxyalkylene glycol ester of a fatty acid represented by the general formula (I)

$$R^1COO(R^2O)_nH \quad (I)$$

or the general formula (II)

$$R^1COO(R^2O)_nOCR^1 \quad (II)$$

(ii) a polyoxyalkylene glycol ether of a fatty alcohol represented by the general formula (III)

$$R^3O(R^2O)_nH \quad (III)$$

iii. a polyoxyalkylene glycol ether of a fatty alcohol esterified with a fatty acid represented by the general formula (IV)

$$R^3O(R^2O)_nOCR^1 \quad (IV)$$

and iv. a polyoxyalkylene glycol condensate of a glyceride esterified with a fatty acid represented by the general formula (V)

$$\begin{array}{l} CH_2OCOR^1{}'O(R^2O)_pOCR^1 \\ | \\ CH-OCOR^1{}'O(R^2O)_qR^4 \\ | \\ CH_2OCOR^1{}'O(R^2O)_rR^4 \end{array} \quad (V)$$

wherein $R^1CO$ represents a saturated or unsaturated fatty acid acyl group having about 12 to 22 carbon atoms;

$R^1$ CO represents a saturated or unsaturated fatty acid acyl group having about 12 to 22 carbon atoms and containing a hydroxy group;

$R^2$ represents an ethylene group;

$R^3$ represents an alkyl or alkenyl group having about 12 to 22 carbon atoms;

$R^4$ represents a hydrogen atom or a $R^1CO$ group;

$n$ is an integer of about 10 to 20; and $p$, $q$, $r$, each is an integer with the sum of $p$, $q$ and $r$ ranging from about 25 to 40 when one or both of $R^4$ is a hydrogen atom and from about 40 to 60 when R is a $R^1CO$ group;

B. about 10 to 40% by weight of an oil-soluble nonionic surfactant component comprising at least one of i. a polyoxyalkylene glycol ester of a fatty acid represented by the general formula (VI)

$$R^1COO(R^5O)_mH \qquad (VI)$$

or the general formula (VII)

$$R^1COO(R^5O)_mOCR^1 \qquad (VII)$$

ii. a polyoxyalkylene glycol ether of a fatty alcohol represented by the general formula (VIII)

$$R^3O(R^5O)_mH \qquad (VIII)$$

iii. a polyoxyalkylene glycol ether of a fatty alcohol esterified with a fatty acid represented by the general formula (IX)

$$R^3O(R^5O)_mOCR^1 \qquad (IX)$$

and iv. a polyoxyalkylene glycol condensate of a glyceride esterified with a fatty acid represented by the general formula (X)

$$\begin{array}{l} CH_2OCOR^1{}'O(R^5O)_sOCR^1 \\ | \\ CH-OCOR^1{}'O(R^5O)_tR^4 \\ | \\ CH_2OCOR^1{}'O(R^5O)_uR^4 \end{array} \qquad (X)$$

wherein $R^1CO$, $R^1$ CO, $R^2$, $R^3$, and $R^4$ are as defined above;

$R^5$ is an alkylene group having 2 to 4 carbon atoms;

$m$ is an integer of about 1 to 5; and $s$, $t$ and $u$ each is an integer with the sum of s, t and u ranging from about 3 to 20;

and

C. about 10 to 50% by weight of an anionic or nonionic surfactant component comprising at least one of i. a phosphate ester and/or salt of a phosphate ester with the adduct of a polyoxyalkylene glycol with an alcohol or an alkylphenol represented by the general formula (XI)

$$R^6O(R^2O)_a-\overset{\overset{O}{\|}}{\underset{\underset{OM}{|}}{P}}-OM \qquad (XI)$$

the general formula (XII)

$$R^6O(R^2O)_b-\overset{\overset{O}{\|}}{\underset{\underset{OM}{|}}{P}}-(R^2O)_cOR^6 \qquad (XII)$$

or the general formula (XIII)

$$R^6O(R^2O)_d-\overset{\overset{O}{\|}}{\underset{\underset{(R^2O)_fOR^6}{|}}{P}}-(R^2O)_eOR^6 \qquad (XIII)$$

wherein $R^2$ is as defined above; $R^6$ is an alkyl group, an alkenyl group or an alkaryl group having about 12 to 18 carbon atoms;

$M$ is an alkali metal metal atom, an alkylamine group or an alkanolamine group;

$a$ is an integer ranging from about 2 to 15; b and c each is an integer with the sum of $b$ and $c$ divided by 2 ranging from about 2 to 15; and $c$, $d$ and $e$ each is an integer with the sum of c, d and e divided by 3 ranging from about 3 to 10;

and (ii) an alkali metal salt, alkylamine salt and/or alkanolamine salt of a fatty acid represented by the general formula (XIV)

$$R^1COOM \qquad (XIV)$$

wherein $R^1CO$ and M are as above defined.

2. The lubricating composition of claim 1, wherein $R^1CO$ is an acyl residue of lauric acid, myristic acid, palmitic acid, stearic acid, arachidic acid, behenic acid, linderic acid, myristooleic acid, palmitooleic acid, oleic acid, gadoleic acid, erucic acid, linolenic acid, arachidonic acid, ricinoleic acid, or a mixture thereof or a mixture of fatty acid residues of the fatty acids of rape seed oil, soybean oil, rice bran oil, palm oil, cotton seed oil, peanut oil, sesame oil, corn oil, lard oil, tallow oil or train oil.

3. The lubricating composition of claim 1, wherein R is an alkyl or alkenyl group selected from the group consisting of a lauryl group, a myristyl group, a palmytyl group, a stearyl group, a arachidyl group, a behenyl group, a linderyl group, a myristooleyl group, a palmitooleyl group, an oleyl group, a gadoleyl group, an erucyl group, a linolenyl group, an arachidonyl group or a ricinolyl group, or mixtures thereof.

4. The lubricating composition of claim 1, wherein the alkyl alkenyl group for $R^6$ is a lauryl group, a myristyl group, a palmityl group, a stearyl group, or an oleyl group and the alkaryl group for $R^6$ is a nonylphenyl group, an octylphenyl group or a dodecylphenyl group.

5. The lubricating composition of claim 1, wherein $R^5$ is an ethylene group.

6. The lubricating composition of claim 1, wherein said composition additionally includes up to about 20% by weight based on the total weight of the lubricating composition of a water soluble solvent or up to about 20% by weight based on the total weight of the lubricating composition of a mineral oil, a fatty oil or a mixture thereof.

* * * * *